US005170572A

United States Patent [19]

Kantro

[11] Patent Number: 5,170,572

[45] Date of Patent: Dec. 15, 1992

[54] TRIPOD SUPPORT INSOLE

[75] Inventor: Scott R. Kantro, New York, N.Y.

[73] Assignee: Insole Control, Inc., New York, N.Y.

[21] Appl. No.: 708,292

[22] Filed: May 31, 1991

[51] Int. Cl.[5] ..... A43B 13/38; A61F 5/14

[52] U.S. Cl. ..... 36/43; 36/44; 36/173; 36/174

[58] Field of Search ..... 36/43, 44, 71, 154, 36/181, 178, 172, 173, 174, 140

[56] References Cited

U.S. PATENT DOCUMENTS

| | | | |
|---|---|---|---|
| 424,195 | 3/1890 | Haag | 36/43 |
| 830,250 | 9/1906 | Preble | 36/44 |
| 1,960,418 | 5/1934 | Schaller | 36/71 |
| 2,055,072 | 9/1936 | Everston | 128/615 |
| 2,221,202 | 11/1940 | Ratcliff | 128/619 |
| 2,423,622 | 7/1947 | Samblanet | 128/619 |
| 2,863,231 | 12/1958 | Jones | 36/71 |
| 2,990,629 | 7/1961 | McLaughlin | 128/614 |
| 3,099,267 | 7/1963 | Cherniak | 128/615 |
| 3,416,245 | 7/1967 | Ferreira | 36/44 |
| 3,421,518 | 1/1969 | Wikler | 128/614 |
| 4,333,472 | 6/1982 | Tager | 128/581 |
| 4,408,402 | 10/1983 | Looney | 36/43 |
| 4,510,700 | 4/1985 | Brown | 36/44 |
| 4,803,989 | 2/1989 | Collins | 128/595 X |
| 4,841,648 | 6/1989 | Shaffer et al. | 36/43 |
| 4,862,605 | 9/1989 | Gardner et al. | 36/43 |
| 4,905,383 | 3/1990 | Beckett et al. | 128/581 X |
| 5,005,575 | 4/1991 | Geri | 36/43 |
| 5,014,706 | 5/1991 | Philipp | 36/43 X |

FOREIGN PATENT DOCUMENTS

| | | | |
|---|---|---|---|
| 1048779 | 2/1979 | Canada | 36/71 |
| 3442502 | 5/1986 | Fed. Rep. of Germany | |
| 2371897 | 7/1978 | France | 36/43 |
| 2625898 | 7/1989 | France | 128/581 |
| 0448804 | 4/1968 | Switzerland | 36/44 |

*Primary Examiner*—Jimmy G. Foster
*Assistant Examiner*—Ted Kavanaugh
*Attorney, Agent, or Firm*—Sherman and Shalloway

[57] ABSTRACT

Cushion to provide tripodal support at the three gait points of the human foot to alleviate pedal dysfunction and associated leg discomfort resulting from pregnancy, obesity, spinal deformity and the like. The cushion comprises support cushions positioned at points corresponding to the locations of the posterior calcaneus, the calcaneal-cuboid region and the base of the first metatarsal bone of a human foot. The support cushions are made of polymeric foam having a density greater than that of a surrounding insole and are positioned to form an obtuse triangle of support that directs the forces generated by walking across the foot so as to provide a near functionally perfect gait. The cushions may be separately adhered to the sock lining within a shoe or formed as part of an insole for temporary or permanent placement in incorporation as part of a shoe construction.

30 Claims, 3 Drawing Sheets

TRIPOD SUPPORT INSOLE

FIELD OF THE INVENTION

The present invention relates to a means for providing tripodal support for the human foot, which means may be individual support cushions insertable into a shoe or incorporated as part of a removable insole or as part of a complete shoe, and which are specifically adapted to provide support and cushioning so as to maintain or restore proper foot posture More particularly, the present invention relates to cushion means which provide support and maintenance or restoration of foot posture to persons whose physical condition has resulted in a shifting of their body's center of gravity or balance away from the optimum thereby putting excessive stress on their feet, legs and lower back.

BACKGROUND OF THE INVENTION

The human foot is subjected to continuous and often excessive force every day and in every form from simply the weight of the body when standing to the extra stress of vigorous exercise and sports. Anatomically, the support provided by the foot for the rest of the body is channeled through three points, namely, the heel and at opposite sides of the ball of the foot. Normally, such support is adequate. However, certain conditions of the human body require increased cushioning and augmentation or modification of the support joints in order to maintain proper foot posture.

Conditions that require such increased cushioning and modified support are often the result of a change in a person's overall body center of gravity or balance as well as an increase in weight. Commonly, such a change occurs in women during the course of nine months of pregnancy. As a woman's weight increases and her center of gravity or balance point changes, her posture alters and stress is placed on the feet differently resulting in fatigue, muscle soreness and conditions, such as strained plantar fascia. Related conditions will include thigh and back pain as well as stress on the knees, all of which are directly connected to changes in foot posture.

Similar conditions are evident in excessively obese people or those suffering from excessive or improper spinal curvature or deformities which results in the body weight being improperly distributed through the foot and an incorrect gait when walking or running.

It is well accepted that walking is excellent exercise, particularly for pregnant women and persons of excessive weight for whom other forms of exercise may be difficult or dangerous. However, the increase in weight experienced by such individuals has an adverse effect on their foot posture and gait that discourages even walking in general much less as a form of exercise. Prior insoles have been devised to provide added support or cushioning to the feet for a variety of purposes and conditions; however, they tend toward providing a continuous cushion from the heel through the entire span of the metatarsals or individual cushions extending beyond the range of the primary gait points. None have targeted only the primary tripodal gait points of the feet as the key support points.

For example, Hara, in U.S. Pat. No. 1,210,066, provides an arch support insole of substantially continuous padding from a centrally thickened heel portion through a substantially narrowed portion on the outside edge of the cuneiform bones to a transverse portion across the first through the fifth metatarsals. In this instance support is provided primarily under the heel and the first and fifth metatarsals.

Ratcliff, in U.S. Pat. No. 2,221,202, provides a cushion support having three distinct cushions in a linear arrangement along the axis of the foot. A heel cushion extends forward to underlie the entire heel area and is of uniform thickness in its body area. An arch cushion extends beneath the mid-portion of the foot including the cuboid bone and the cuneiform arch. This cushion provides support for the three cuneiform bones, the scaphoid and cuboid bones, the rearward ends of the five metatarsals and a portion of the forward end of the os calcis. A third cushion provides support under the metatarsals and primarily the mid-sections of the 2nd through 4th metatarsals.

Hiss, in U.S. Pat. No. 2,426,735, provides a stabilizing pad insert for shoes which is formed of different densities of rubber to provide a single pad having heel, cuboid and metatarsal cushioning. The heel portion includes a flange extension and raised area designed to throw the weight laterally toward the firm portion of the pad beneath the cuboid bone while the forward portion is arched and extends transversely across the area beneath the metatarsal heads.

Looney, in U.S. Pat. No. 4,408,402, provides a shoe or shoe insert which serves to provide increased support at four specific areas of the foot through the three trimesters of a woman's pregnancy. The four support areas are the heel, directly under the longitudinal arch and longitudinally under the big and little toe of each foot.

When walking, forces are directed through three gait points forming a tripodal arrangement on the plantar surface of the foot; the posterior calcaneus, the calcaneal-cuboid area and the base or posterior end of the first metatarsal bone. It has been found that, by providing increased cushioning and support to only these three specific points, it is possible to attain a near functionally perfect gait even for those whose body weight or conditions tend to disrupt their overall foot posture.

It is therefore an object of this invention to provide a means for cushioning the plantar surface of the foot in such a manner as to induce proper posture to the foot.

It is a further object to provide a means wherein cushions are arranged in a tripodal manner relative to the underside of the foot.

It is a still further object to provide cushioning means at the locations of the posterior calcaneus, the calcaneal-cuboid area and the base of the first metatarsal bone forming a tripodal support network for the foot.

It is another object to provide an insole that is removable from a shoe and which has cushioning means at the three specified points.

And it is still another object to provide an insole of this nature which may be an integral part of a shoe.

And it is a still further object to provide a shoe incorporating a tripodal support network in its construction.

DETAILED DESCRIPTION

Figure 1:
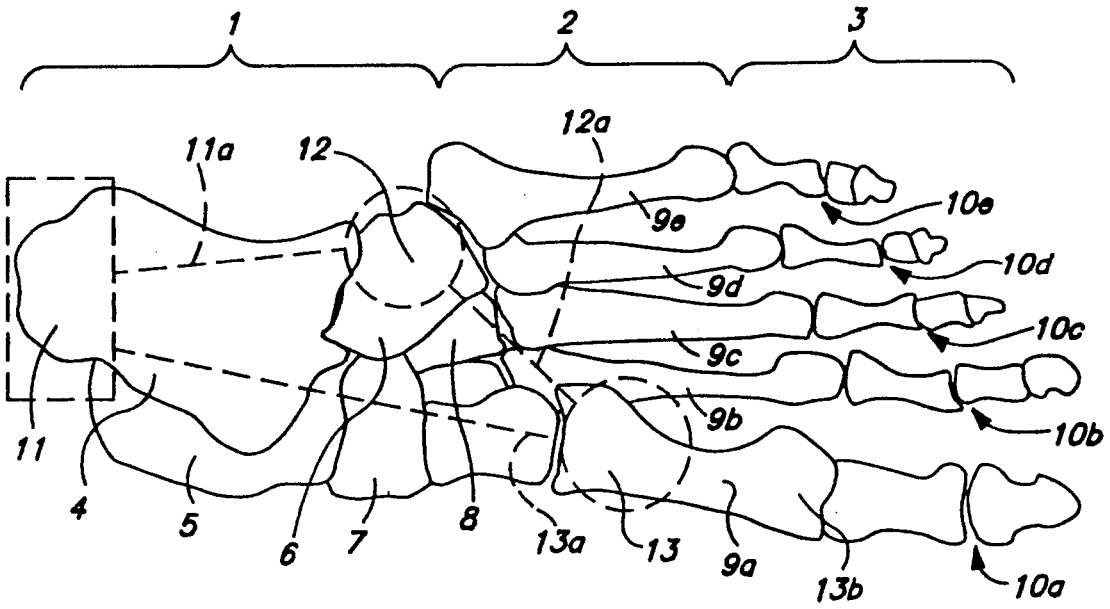
FIG. 1 is a planar skeletal view of the plantar surface bones of the foot with the support points according to the present invention indicated.

Anatomically the foot is comprised of a series of bones divided into three groups as shown in FIG. 1; the tarsal bones 1, the metatarsal bones 2, and the phalanges 3. Within the tarsal grouping 1, are the calcaneus 4, the talus 5, the cuboid 6, the navicular 7, and the three cuneiform bones 8. The rest of the skeletal foot is made up of the first through fifth metatarsals 9*a–e* and the first through fifth phalanges 10*a–e*.

A three point, or tripodal support arrangement that coincides with the main force points encountered when walking is shown in FIG. 1 by phantom lines 11*a*, 12*a* and 13*a* which connect the three points 11, 12 and 13. It is these points that are the normal gait points of the foot. In a normal gait the primary force point and the first to contact the ground, is the posterior calcaneus 11. As the step progresses, the weight shifts along line 11*a* to the calcaneal-cuboid area 12 at the outside of the longitudinal instep arch of the foot in the area of the navicular 7 and cuneiform bones 8. From there, as the foot flexes to the final position of the step, force and body weight is applied across the metatarsal zone, and along line 12*a* from the calcaneal-cuboid area 12 to the base or posterior end 13 of the first metatarsal bone 9*a* thence to the head or anterior end 13*b* of the first metatarsal for the final push off.

As weight increases and its distribution on the body changes, more cushioning is required to lessen shock to the foot, also support at the specific gait points is necessary to permit the foot to maintain its proper posture as well as to alleviate stress and strain upward through the legs and into the lower back caused by improper foot posture. Similar cushioning and support is needed for those persons who suffer from spinal deformities whether resulting from accidents or congenital defect(s).

Toward this end the present invention provides means for obtaining such cushioning and support as well as guiding the direction of the forces across the primary gait points of the foot. These means comprise primary cushion elements positioned or positionable within a shoe relative to the gait points of a particular individual. Alternatively, the invention may comprise an insole that may be built in as an integral part of the shoe or may be removable therefrom and preferably comprising a foot or shoe shaped foam member 14, similar to conventional cushion insoles, having a contoured upper surface with a longitudinal lateral instep cushion 16. The lower surface 17 is substantially planar, curling upward slightly around the forward periphery 18 to contour and cushion the user's toes. Insole member 14 need not be a complete foot length, merely long enough to include the area of the base 13 of the first metatarsal bone 9*a*.

The invention may take a further form in that a shoe may be constructed with the cushion elements as an integral part of the shoe sole, preferably in the inner sole, but also conceivably as areas of increased density in outer sole. This may be an integral part of any type of shoe from dress shoes to specific varieties of sport shoes.

Figure 2:
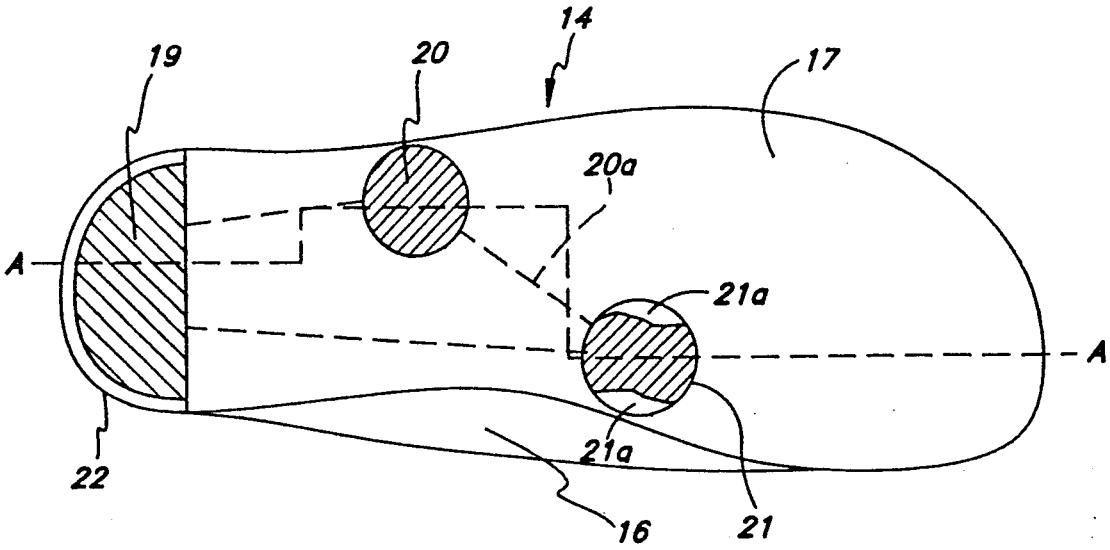
FIG. 2 is a planar view of the bottom surface of an insole according to the present invention with the support points indicated.

Cushion and support areas shown in FIG. 2 correspond to the gait points of the foot shown in FIG. 1 and show their relationship to a full foot insole member 14. Specifically, heel cushion 19 corresponds to the posterior calcaneus 11, cuboidal cushion 20 corresponds to the calcaneal-cuboidal area 12 and the metatarsal cushion 21 corresponds to the location of the base 13 of the first metatarsal bone 9*a*. As with the gait points of the foot, these cushions form a tripodal arrangement increasing the support and cushioning at these specific gait points.

Figure 4:
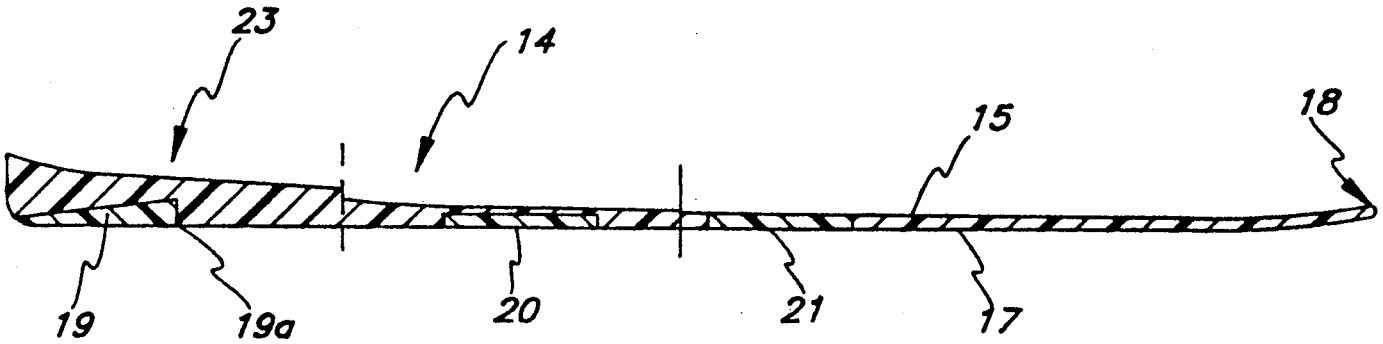
FIG. 4 is a longitudinal cross-section taken along line A—A of FIG. 2 illustrating a second embodiment of an insole according to the present invention.

Cushions 19, 20 and 21 are preferably formed from a polymeric foam material of a high density to provide the necessary support at the gait points. The relative positions and sizes of cushions 19, 20 and 21 are such that they provide the extra cushioning and support only at the specific gait points 11, 12 and 13. To this extent heel cushion 19 extends across the entire lateral width of the heel portion 22 of the foot but extends forward a distance of no more than about one half the length of the complete heel pocket area 23 of insole 14. This is most clearly shown in FIG. 4. In pregnant women and obese persons, the balance point of the body tends to shift rearward to counter the excess weight in the abdominal region. When this occurs, more force is placed on the heel than normal and the weight is not distributed evenly along the foot. To counteract this tendency, the center of balance, and thereby the weight distribution over the foot, must be redirected forward. To accomplish this, heel cushion 19 is tapered through its thickness from its forward edge 19*a* rearward. In this manner, heel thrust is directed rearward forcing the body forward to re-establish a proper center of balance over the foot.

As a step progresses, there is a tendency for the feet of pregnant women and of obese persons to roll outward or to exhibit excessive pronation, also as a result of the increase in weight and change in balance. Cuboidal cushion 20 counteracts this tendency by providing support and cushioning to the calcaneal-cuboidal area of the foot and particularly at gait point 12 centered under the outer portion of the cuboid bone 6. To further mitigate the tendency toward pronation, cuboidal cushion 20 is also tapered alone an axis directed at an angle relative to the longitudinal axis of the insole along line 20*a* toward the gait point located at the base 13 of the first metatarsal bone 9*a* and the metatarsal cushion 21. This corresponds to the direction of force along line 12*a* in FIG. from the calcaneal-cuboid gait point 12 to the first metatarsal base gait point 13.

Although the major force vectors pass through the foot from the calcaneal point 11 to the calcaneal-cuboid point 12 to the first metatarsal base gait point 13 in that order, a portion passes directly from the calcaneal point 11 to the first metatarsal point 13 across the region of the longitudinal arch formed by the talus 5, navicular 7 and cuneiform bones 8. This region acts in the nature of a leaf spring allowing the foot to flex but absorbing and distributing shock. To avoid interfering with this function, cushions 19, 20 and 21 should not extend into the arch area. In order for metatarsal cushion 21 to accept forces directed from both the calcaneal 11 and calcaneal-cuboid gait point 12 through their respective cushions 19 and 20, as well as the force of final push-off at the completion of a step with the desired stabilization of the first metatarsal 9*a*, it should be of even thickness at least in a longitudinal direction relative to the shaft of the first metatarsal bone 9a with no (or only minimal) taper in any direction.

Whereas heel cushion 19 is shown as, and is preferably, substantially semi-circular in shape corresponding to the rearward portion of the heel area of the foot, cuboidal cushion 20 and metatarsal cushion 21 are preferably circular in plan with diameters closely related to the size of their specific relative gait points. However, other shapes, such as ellipses, ovals, rectangles or the like, may suitably be used particularly in the case of patients with longer than average feet or with specific conditions requiring particular support features. Additionally, it is within the concept of this invention that cuboid cushion 20 and metatarsal cushion 21 could be part of a single piece extending diagonally from gait point 12 to gait point 13, as long as the mid-section of such a single piece is of a sufficiently low density to avoid interference with the spring action of the foot arch. Separate cushions are preferred. In the case of cuboidal cushion 20, the diameter or width is at least two-thirds the width of the plantar surface of cuboid bone 6 and no greater than the width of this bone. As for metatarsal cushion 21, its diameter or width is generally at least equal to the width of the base or posterior end of the first metatarsal bone 9a and preferably one-fourth to one-third again as wide as that part of the first metatarsal.

The positioning of cuboidal cushion 20 and metatarsal cushion 21 is important to the proper functioning of the insert and the foot. Cuboidal cushion 20 should be positioned to overlap the outer edge of the cuboid bone 6 and be substantially midway between the anterior end of the calcaneus 4 and posterior end of the fifth metatarsal 9e. Preferably, cuboidal cushion 20 is of sufficient diameter or width to overlap the calcaneal-cuboidal and the cuboidal-metatarsal joints. The rotational positioning of cuboidal cushion 20 is such that the taper is angled relative to the longitudinal axis of the insert and the foot toward the base 13 of the first metatarsal bone 9a and metatarsal cushion 21 along line 20a.

Metatarsal cushion 21 is centered over the posterior end or base 13 of the first metatarsal bone 9a, corresponding to the gait point thereof, and extends forward from that point in a direction along the metatarsal, preferably at least 4 mm. When metatarsal cushion 21 has an elongate shape it should be oriented in line with the metatarsal bone 9a and extend no more than one half its length. A negative skive 21a is provided on at least the edge of the cushion facing cuboidal cushion 20 and extending forward in line with the shaft of the first metatarsal 9a. In this manner, metatarsal cushion 21 accepts the transference of weight to the gait point at the base 13 of the first metatarsal and stabilizes the first metatarsal bone 9a for the propulsionary gait phase or push-off. At this location, metatarsal cushion 21 may partially overlap the joint between the first metatarsal bone 9a and the adjacent cuneiform bones 8. However, it is preferred that such overlap not occur and that cushion 21 underlie only the first metatarsal bone 9a.

Figure 3:
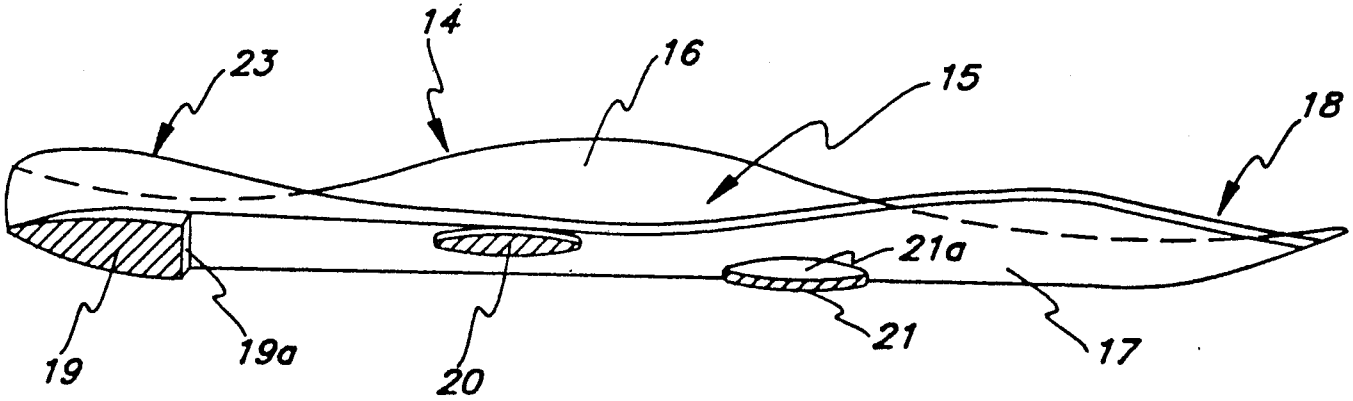
FIG. 3 is a side perspective view of a first embodiment of an insole according to the present invention.
Figure 5:
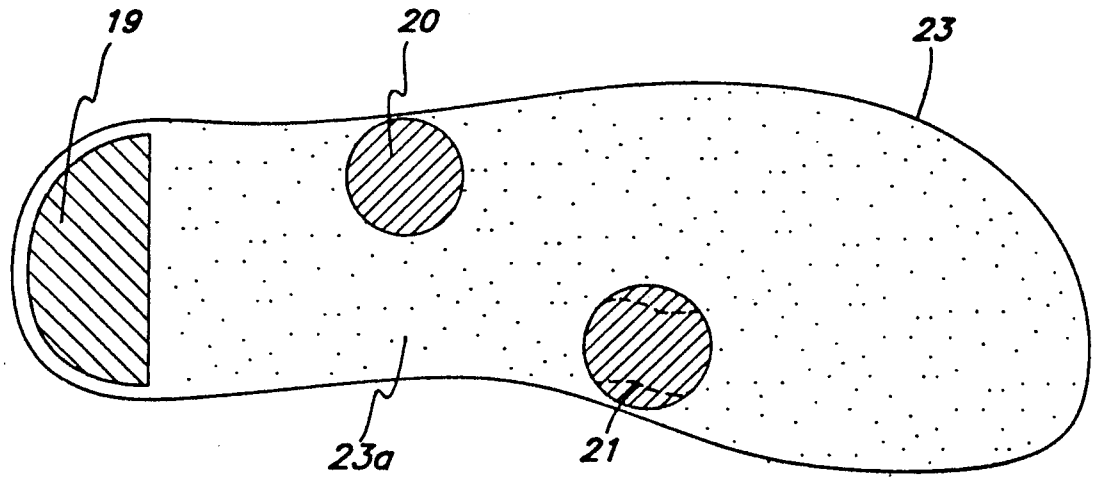
FIG. 5 is a planar view of a means for placement of support cushion means employing a tacky sheet.

As previously noted, cushions 19, 20 and 21 are preferably formed from a polymeric foam. The density of this foam should be higher than that of the surrounding insole whether a separate removable insole member 14 or a built-in member that is part of a shoe. Where the cushions are individual units for insertion within a shoe absent a surrounding insole member, the surface to contact the sock lining of the shoe should have a means to secure them in place. This may be a pressure sensitive adhesive coated on the cushions and protected by a release sheet, an adhesive for application at the time of insertion or another means such as a loop and pile type means that will grip the sock lining in the shoe. Additionally, a means for positioning the cushions within the shoe may be provided which may involve individually placing the cushions within the shoe or, as shown in FIG. 5, they may be first positioned on a tacky sheet 23 of a size and shape corresponding to that of an individual's foot, thereby locating them correctly relative thereto. The adhesive may then be exposed or applied and the sheet inserted into the shoe to effect correct placement of the cushions. The sheet may be left in place or removed, in which case the tackiness thereof, represented by stippling 23a, is significantly less than the adhesiveness of the support cushions. For accurate location of the support cushions using this method, the sheet is first placed against a patient's foot and may be slightly tacky on both sides to facilitate such placement. Accurate registration within the shoe is achieved merely by placing the sheet with the attached cushions in the shoe heel first with the curve of the heel cushion against the curve of the heel portion of the shoe upper.

Where the cushions are provided as part of an insole, the insole may be constructed as an integral part of a shoe or as a separate unit for insertion and removal by the user. In either case two methods of construction are preferred. The first, shown in FIG. 3, comprises a foot or shoe shaped body 14 formed from a polymeric foam material of uniform density and having an upper surface 15 molded to the contours of the plantar surface of the foot. Body 14 may include a longitudinal lateral instep cushion 16. On the basis of averages of anatomic measurements or on actual measurements of an individual patient, cushions 19, 20 and 21 are adhered to the underside 17 of body 14 in their appropriate positions. Cushions 19, 20, and 21 are preferably formed from a polymeric foam of greater density than that of body 14 and, preferably, of sufficient density to allow for minimal thickness of the cushions. Such minimal thickness is desired to avoid adverse effects and discomfort which result from unevenness of surface. This method of construction allows the insole of the 10 invention to be quickly and easily constructed for patients on an individual and customized basis from a standard kit comprising preformed foamed bodies 14 and cushion sets 19, 20, and 21.

The second method of construction is more in the nature of a mass production method wherein the positioning of cushions 19, 20 and 21 is based on a statistical average of anatomic measurements and shoe size. In this method, body 14 is molded from a first foam material so as to have depressions in its underside 17 corresponding to gait point locations 11, 12 and 13. These depressions are then filled with a second polymeric foam material having a greater density which is allowed to cure and form cushions 19, 20 and 21. Alternatively, cushions 19, 20 and 21 may be preformed and body 14 molded around them. In either case, the resulting insole will be as that shown in FIG. 4 with cushions 19, 20 and 21 embedded within body 14.

A third method envisions a body 14 molded from a foam material which has the property of forming areas of different density during curing. In this manner the insole body and the cushion areas are an integral unit that is not susceptible to separation. Such a method would have particular suitability where the insole is to be incorporated as an integral part of a shoe construction.

All three methods of construction are equally applicable to incorporation of the cushion support means directly into the sole of a shoe whether as part of the inner sole or the outer sole.

The tripodal support and cushioning means and device according to this invention are broadly applicable to a wide variety of shoe constructions and types which are otherwise well known in the art. For instance, various types of athletic or support shoes, including, for example, all purpose and specialty sneakers, including running shoes, cross-country shoes, aerobic shoes, basketball shoes, tennis shoes, and the like, and also dress shoes, working shoes, etc., include both regular types of shoes or half- or full-size boots.

It will be apparent to those of ordinary skill in the art that various materials and other modes of construction may be employed in accordance with the present invention and that various modifications can be made without departing from the scope of the following claims.

What is claimed is:

1. A device for providing tripodal support and cushioning at the primary gait points of the human foot comprising:

a. a heel cushion having a rearward taper for placement under the extreme posterior end of a human heel, b. a cuboid cushion having a thickness taper along an axis thereof for placement substantially medially along the length of said foot adjacent one edge thereof to correspond to the calcaneal-cuboidal region of said foot, said cushion being rotationally positioned such that said taper is directed at an angle relative to the longitudinal axis of said foot toward the posterior end of the first metatarsal bone of said foot, and c. a metatarsal cushion for placement forward of said cuboid cushion and adjacent the opposite edge of said foot to correspond to the location of the posterior end of the first metatarsal bone of said foot, means for positioning said cushions corresponding to the apices of an obtuse triangle on the under surface of said foot forming a tripodal support in conjunction with the gait points at the heel, the cuboid bone and the posterior end of the first metatarsal bone to thereby cushion, absorb and direct the forces generated in pedestrian motion from the heel through the calcaneal-cuboidal gait point to the posterior end of the first metatarsal.

2. The tripodal support and cushioning device of claim 1 wherein said metatarsal cushion is centered over and has a width at least equal to the width of the posterior end of the first metatarsal bone and extends forward therefrom along said first metatarsal a distance of at least 4 mm but no more than one half the length of said first metatarsal bone and wherein said cushion has a negative skive extending forward along at least one edge thereof along the shaft of said first metatarsal bone.

3. The tripodal support and cushioning device of claim 2 wherein said metatarsal cushion has an elongated shape and is positioned with its long axis along the longitudinal axis of said first metatarsal bone.

4. The tripodal support and cushioning device of claim 1 wherein said cushions are formed from high density foam.

5. The tripodal support and cushioning device of claim 1 wherein said positioning means comprises means for adherence of said cushions to the inner sole of a shoe.

6. The tripodal support and cushioning device of claim 5 wherein said positioning means comprises means for positioning said cushions within a shoe.

7. The tripodal support and cushioning device of claim 6 wherein said positioning means comprises a tacky sheet corresponding in size and shape to a human foot and on which said cushions may be temporarily located relative to said gait points for insertion into a shoe.

8. The tripodal support and cushioning device of claim 5 wherein said adherence means comprises a pressure sensitive adhesive on one surface of said cushions.

9. The tripodal support and cushioning device of claim 5 wherein said adherence means comprises an adhesive applicable to said cushions.

10. The tripodal support and cushioning means of claim 5 wherein said adherence means comprises means capable of gripping a sock lining of a shoe.

11. An article of footwear for providing tripodal support and cushioning at locations corresponding to the heel, cuboid bone and posterior end of the first metatarsal bone comprising:

an outersole, an insole and an upper and cushions located within said article of footwear at said heel, cuboid bone and metatarsal bone locations, said cushions comprising:

a heel cushion having a rearward taper located beneath the posterior calcaneus, a cuboid cushion having a thickness taper along an axis thereof located beneath the cuboid bone and rotationally positioned such that said taper is directed at an angle relative to the longitudinal axis of said foot toward the posterior end of the first metatarsal bone, and a metatarsal cushion located beneath said posterior end of said metatarsal bone;

wherein said cushion means are confined to said locations and are of greater density than said insole.

12. The article of footwear according to claim 11 said cushions are an integral part of said insole.

13. An article of footwear according to claim 11 comprising a dress shoe.

14. An article of footwear according to claim 11 comprising a work shoe.

15. An article of footwear according to claim 11 comprising an athletic shoe.

16. A method of maintaining or restoring foot posture comprising providing support means comprising cushions positionable within a shoe at points corresponding to specific locations of a human foot corresponding to the posterior calcaneus, the cuboid and the posterior end of the first metatarsal bone, said cushions having densities greater than the surrounding material of said shoe, wherein said cushions comprise:

a. a heel cushion having a rearward taper located beneath the posterior calcaneus, b. a cuboid cushion having a thickness taper along an axis thereof located beneath the cuboid bone and rotationally positioned such that said taper is directed at an angle relative to the longitudinal axis of said foot toward the posterior end of the first metatarsal bone, and c. a metatarsal cushion located beneath said posterior end of said first metatarsal bone, and positioning said support means within said shoe beneath said specific locations.

17. The method of claim 16 wherein said heel cushion has a width corresponding to the width of the heel of a human foot and extends forward a distance of no more than one half the length of said heel.

18. The method of claim 16 wherein said cuboid cushion has a width of from about two-thirds the width to the full width of the plantar surface of the cuboid bone of the human foot.

19. The method of claim 16 wherein said metatarsal cushion has a width at least equal to the width of the posterior end of the first metatarsal bone of the human foot and no greater than one-third again as wide thereof and a length at least 4 mm longer than said posterior end but no longer than one-half the length of the first metatarsal bone.

20. The method of claim 16 wherein said cuboid cushion is centered over said cuboid bone.

21. The method of claim 16 wherein said metatarsal cushion is centered over said posterior end of said first metatarsal bone and has a negative skive extending forwardly along at least one edge thereof.

22. An insole providing tripodal support at three force points of the human foot, said force points coinciding with normal gait points of the foot located at the posterior calcaneus, the calcaneal-cuboidal region and the posterior end of the first metatarsal bone of the human foot, said insole comprising a flexible pad extending at least partially beneath the foot from heel to toe and having attached thereto a plurality of support cushion means positioned at locations corresponding to said force points, whereby said support cushion means comprise means to support said foot at said points and to direct forces of pedestrian motion consecutively across said force points in a triangular pattern from the posterior calcaneus through the calcaneal-cuboidal region to the posterior end of the first metatarsal bone; wherein said pad is formed from a polymeric foam material having a first density, an upper surface molded to the contours of the human foot and a substantially planar lower surface, said support cushion means are formed from a polymeric foam material having a second density which is greater than said first density an comprise:

a. a heel cushion located at the extreme posterior end of said pad, b. a cuboid cushion located substantially medially along the length of said pad and adjacent one edge thereof to correspond to the calcaneal-cuboidal region of a human foot, and c. a metatarsal cushion located forward of said cuboid cushion and adjacent to opposite edge of sad pad to correspond to the location of the posterior end or base of the first metatarsal bone of the foot, and said cushion positions corresponding to the apices of an obtuse triangle on the undersurface of said pad; wherein said heel cushion is tapered in its thickness from its forward edge rearward and said cuboid cushion is tapered in its thickness along an axis thereof and is positioned such said taper is directed diagonally across the longitudinal axis of said pad toward said metatarsal cushion.

23. The insole of claim 22 wherein said support cushion means are adhered to the lower surface of said pad.

24. The insole of claim 22 wherein said support cushion means are molded into said pad.

25. The insole of claim 22 wherein said heel cushion extends forward from the posterior end of said pad a distance of no more than about one-half the length of a heel pocket molded in the upper surface of said pad.

26. The insole of claim 22 wherein said cuboid cushion has a width of from about two-thirds the width to the full width of the plantar surface of the cuboid bone of the human foot.

27. The insole of claim 22 wherein said metatarsal cushion has a width at least equal to the width of the posterior end of the first metatarsal bone of the human foot and no greater than one-third again as wide thereof.

28. The insole of claim 22 wherein said metatarsal cushion has a width at least equal to the width of the posterior end of the first metatarsal bone of the human foot and extends forward therefrom a distance of at least 4 mm but no longer than one half the length of the first metatarsal bone.

29. The insole of claim 28 wherein said metatarsal cushion is centered over said posterior end of said first metatarsal bone and has a negative skive extending forwardly along at least one edge thereof.

30. The insole of claim 22 wherein said cushion means are integrally connected to said pad and comprise areas of greater density formed during curing of said foam.

* * * * *